US006966492B2

(12) United States Patent
Wahler

(10) Patent No.: US 6,966,492 B2
(45) Date of Patent: Nov. 22, 2005

(54) GEAR ARRANGEMENT FOR ALTERNATELY ACTUATING TWO READING/WRITING UNITS FOR CHIP CARDS

(75) Inventor: Torsten Wahler, Bad Duerrheim (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/773,249

(22) Filed: Feb. 9, 2004

(65) Prior Publication Data

US 2004/0159706 A1 Aug. 19, 2004

Related U.S. Application Data

(63) Continuation of application No. PCT/DE02/03038, filed on Aug. 19, 2002.

(30) Foreign Application Priority Data

Aug. 22, 2001 (DE) ..... 101 41 177

(51) Int. Cl.[7] ..... G06K 7/00
(52) U.S. Cl. ..... 235/453; 235/475
(58) Field of Search ..... 235/453, 475; 74/110

(56) References Cited

U.S. PATENT DOCUMENTS 6,470,762 B1 * 10/2002 Burkart ..... 74/110

FOREIGN PATENT DOCUMENTS

| | | |
|---|---|---|
| DE | 200 15 100 U1 | 1/2001 |
| EP | 0 696 776 A2 | 2/1996 |
| EP | 0 899 676 A2 | 3/1999 |

OTHER PUBLICATIONS

Derwent Abstract; DE20015100U1; Jan. 25, 2001; Mannesmann VDO AG.
Derwent Abstract; EP0696776A2; Feb. 14, 1996; Mannesman Kienzle GmbH.
Derwent Abstract; EP0899676A2; Mar. 3, 1999; Mannesmann VDO Aktiengesellschaft.

* cited by examiner

*Primary Examiner*—Diane I. Lee
*Assistant Examiner*—Lisa M. Caputo
(74) *Attorney, Agent, or Firm*—Jacob Eisenberg Siemens AG

(57) ABSTRACT

The present invention relates to a gear arrangement actuated by a control motor. The motor can be reversed in its rotational direction in order to emit a chip card of a tachograph for example. The gear arrangement is provided with a slide-rod for each reading/writing unit, the slide-rod being embodied in the form of a toothed rack being able to be displaced in the direction of movement of the chip card. A control slider which is actuated by the control motor is coupled gearwise to the slide rods so that when the control slider is displaced, the slide rods carry out a movement in opposite directions.

11 Claims, 2 Drawing Sheets

GEAR ARRANGEMENT FOR ALTERNATELY ACTUATING TWO READING/WRITING UNITS FOR CHIP CARDS

CROSS REFERENCE TO RELATED APPLICATIONS

The present application is a continuation of international application PCT/DE02/03038, filed 19 Aug. 2002, and further claims priority to German patent application 10141177.4, filed 22 Aug. 2001, the both of which are herein incorporated by reference.

BACKGROUND OF THE INVENTION

The present invention relates to a gear arrangement for alternately actuating two reading/writing units for chip cards, these units being arranged essentially in one plane in a tachograph, for the purpose of transporting a respective chip card into the withdrawal position, having a servomotor, of which the direction of rotation can be reversed, and a control slide, which is in operative connection, in terms of gearing, with the servomotor.

Tachographs of the generic type are generally designed as built-in devices with a flat, cubical built-in housing. A very small amount of installation space is thus available for the reading/writing units and the drive means, which cause the chip cards which are located in the reading/writing position, and are locked in this state, to be moved into the withdrawal positions. On the other hand, chip cards which are deformed, i.e. become curved or corrugated, during use require a considerable amount of force in order for it to be possible for them to be moved into the withdrawal position. However, cost limits and the fact that there is a considerable shortage of space on the format-filling printed circuit board, in respect of the housing of the tachograph, mean that, rather than it being possible for each reading/writing unit to be assigned a servomotor, a single servomotor has to be provided for the two reading/writing units, this single servomotor being controlled in a suitable manner and, with the interposition of a gear arrangement which deflects the force flux, alternately causing one chip card or the other to be transported into the withdrawal position.

The restrictive conditions mentioned above, of course, also influence the selection of the servomotor in respect of its power, it being possible for the torque requirement which has to be met by the servomotor to be reduced by a high gearing-related reduction ratio being provided between the servomotor and the actuating members assigned to the reading/writing units. This results in a possibly unreasonably long waiting period as a chip card is being discharged, and requires increased gearing outlay with correspondingly large amounts of space being required.

A gear arrangement which is known in this context from DE-U-200 15 100.2 provides means in the form of a wedge mechanism between a control slide, which is driven by a servomotor, and the carriages, which are mounted in the relevant reading/writing units and are assigned to the chip cards, in order to deflect the movement of the control slide in the discharge direction of the chip cards. Such a drive connection, on account of high frictional losses and as a result of transverse forces and the system-induced division of forces, requires increased power of the servomotor and, as a result of the necessary guidance accuracy of the components on which the wedge-mechanism elements are formed, gives rise to very high production outlay.

SUMMARY OF THE INVENTION

An object of the present invention is to provide a gear arrangement of the generic type which, with the smallest possible number of components, which are compatible with series production and installation, provides for optimum utilization of the available power of the servomotor, along with a high level of functional reliability.

This object is achieved in that each reading/writing unit is assigned a push rod which can be displaced in the direction of the movement of the chip cards, and in that the control slide engages, in terms of gearing, with each push rod such that, when the control slide moves, the push rods execute movements in opposite directions.

A preferred exemplary embodiment is characterized in that preferably two identically configured carriers are provided, in that guides for the push rods and the control slide are formed on the carriers, in that the control slide is designed as a rack with opposite toothing formations, and in that mounted in the carriers is in each case one gearwheel which engages with the respective push rod and with a toothing formation of the control slide.

Further advantageous configurations of the invention are described in the non-cited subclaims.

The critical advantage of the invention can be seen, in particular, in that it can be realized with technically straightforward, robust and easily installable means and on account of the form fit of the gear components and of the fact that the pushing force acts exclusively in the movement direction of the chip cards and provides good efficiency and a high level of functional reliability. Furthermore, the solution which has been found is largely insensitive to tolerances and allows the servomotor to run more uniformly and thus makes it possible to use the available motor power to better effect and/or to use a servomotor of relatively low power which is adapted to the amount of force required.

It should also be emphasized that two bearing housings which are of completely identical construction and comprise the carriers and the respectively associated coverings are provided, but the rack, which serves as control slide, is arranged and guided in the bearing housings, and engages with the pairs of gearwheels, differently such that, in each movement direction of the control slide, an oppositely directed movement of the push rods provided for discharging the chip cards takes place and thus in each case one push rod remains inactive in respect of the transportation of one chip card. The invention can be used irrespective of whether in the reading/writing units, using an over-center device, the chip cards introduced are transported automatically into the reading/writing position, or whether the chip cards are pushed manually, with the possible use of a carriage or of a drawer in which the chip cards are positioned, into the reading/writing position and are locked in a suitable manner in this position.

It is also immaterial as to whether the reading/writing units of the gear arrangement which has been found are arranged closely together or relatively far apart from one another. Moreover, it should also be pointed out that at least the carriers may be designed as a component on which, if appropriate, the bearing locations of the reduction gear are also formed and thus the servomotor, which is arranged on the opposite side of the printed circuit board, engages in the gear arrangement merely by way of the pinion fastened on the motor shaft.

BRIEF DESCRIPTION OF THE SEVERAL VIEWS OF THE DRAWINGS

The invention is explained in more detail hereinbelow with reference to drawings, in which.

DETAILED DESCRIPTION OF THE INVENTION

Figure 1:
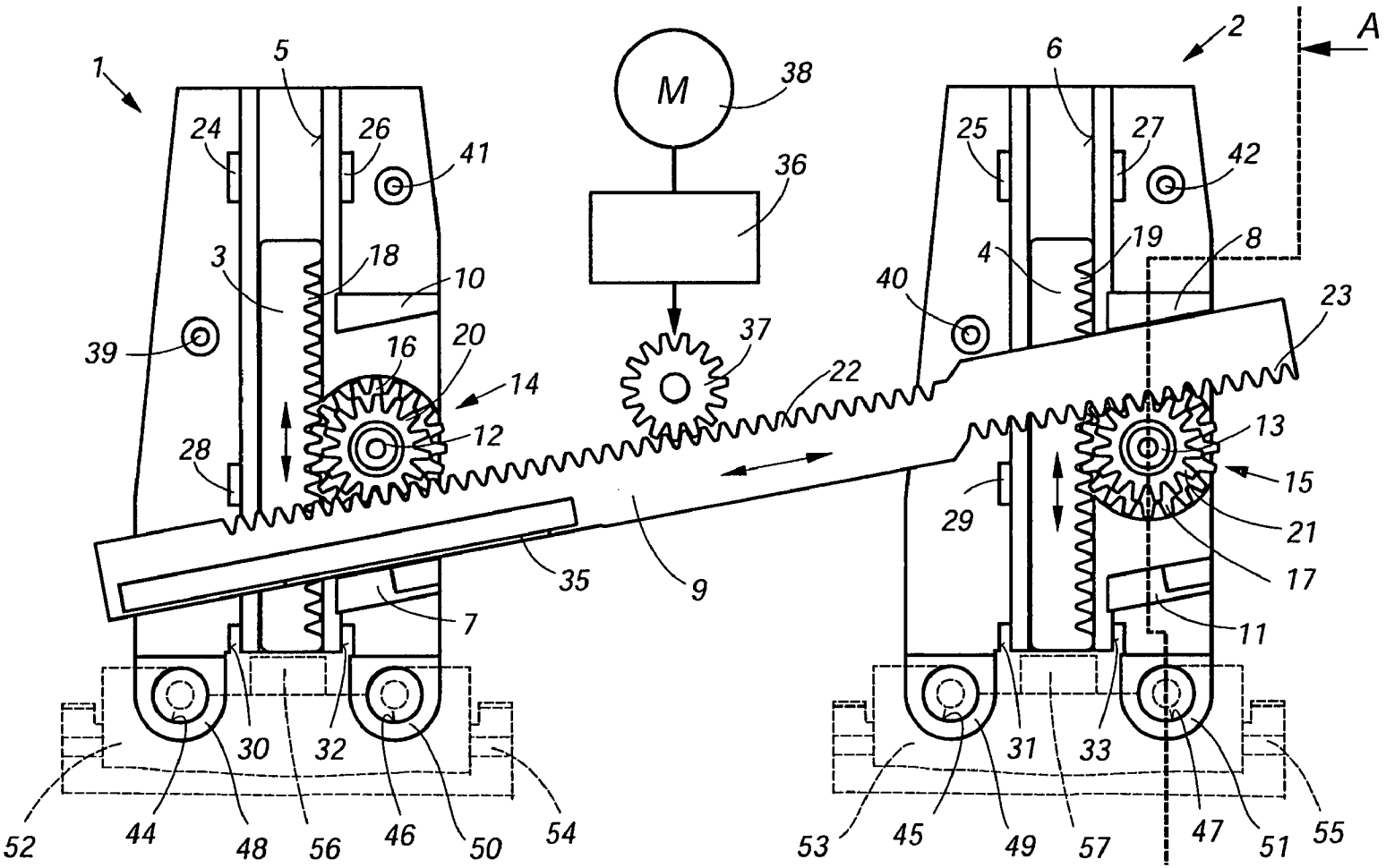
FIG. 1 shows a plan view of the gear arrangement according to the invention partly illustrated in schematic form, the coverings which are assigned to the carriers having been removed.

As can be seen from FIG. 1, the gear arrangement comprises two identically configured carriers 1 and 2, in which are formed guide grooves 5 and 6 provided for push rods 3 and 4. 7 and 8 designate supports which are assigned to a control slide 9 and serve as lateral guide elements. The exchangeability of the carriers 1 and 2 requires a further support 10 and 11 to be formed in each case. 12 and 13 designate pins which are integrally formed directly on the carriers 1 and 2. A pair of gearwheels 14 and 15 is mounted in each case on the pins 12, 13. The pairs of gearwheels 14, 15 engage, by way of respective toothed rings 16 and 17, in each case one respective toothing formation 18, 19 formed on the push rods 3, 4, and the toothed rings 20 and 21 of the respective pairs of teeth 14, 15 mesh with respective toothing formations 22 and 23 which are formed alternately on the control slide 9, and are preferably located in one plane. It should be pointed out here that the pairs of gearwheels 14, 15 may also be designed in each case as an identically toothed gearwheel, in which case there is no need for any step-up transmission between the control slide 9 and the push rods 3, 4, if, over the predetermined installation width of the relevant tachograph, there is a sufficient amount of travel displacement available to the control slide 9 for transporting a chip card out of the reading/writing position, i.e. the reading/writing units, in contrast to the exemplary embodiments selected, are located more closely to one another. Through-passages 24, 25, 26, 27, 28 and 29 and slots 30, 31, 32, and 33 serve for the fastening of likewise identically configured coverings 34 (FIG. 3) on the carriers 1 and 2. The coverings 34 here serve not just as a contact guard, by completing a bearing housing in each case, but also as a guide part in respect of the push rods 3 and 4 and of the control slide 9 and as an axial securing means in respect of the pairs of gearwheels 14, 15.

It can also be gathered from FIG. 1 that a lug 35 is integrally formed on the control slide 9 at right angles to the plane of the toothing formations 22, 23, the lug serving, in interaction with two fork-type light barriers (not illustrated), for controlling the servomotor 38, which is in operative connection with the control slide 9 via a reduction gear 36 and the pinion 37 thereof. Depending on the activated direction of rotation of the servomotor 38, starting from the neutral rest position of the gear arrangement according to FIG. 1, either the push rod 3 or the push rod 4 is activated in the discharge direction of a chip card and guided back into the rest position again in order to ensure renewed introduction of a chip card. At the same time, on account of the form fit in gearing terms, the respectively other push rod 3 or 4 executes a movement in the opposite direction, i.e. a movement which does not have any influence on the chip card assigned to this push rod.

Figure 3:
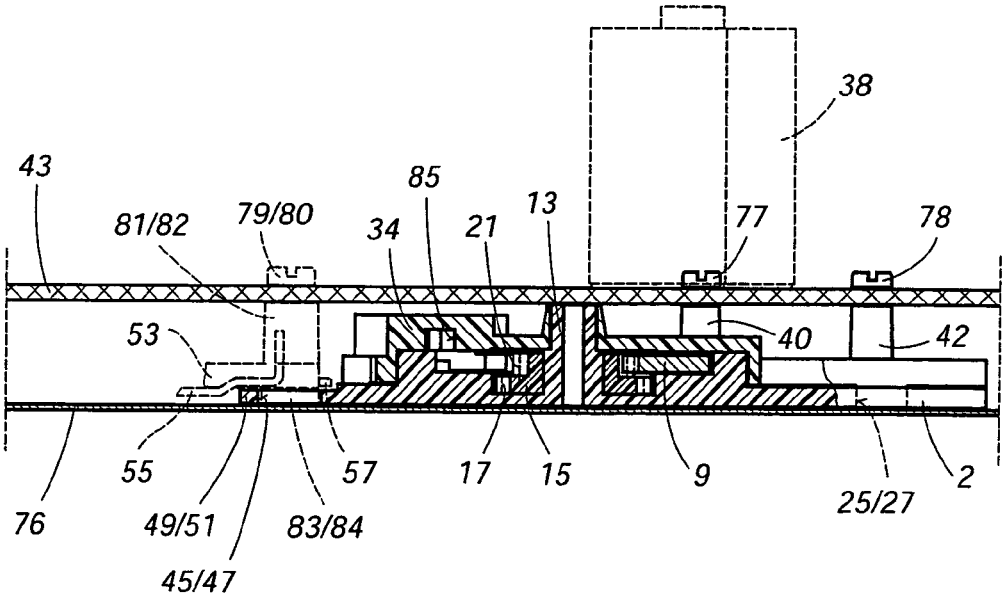
FIG. 3 shows a partial section of the gear arrangement along section line A in FIG. 1 for the purpose of illustrating the positioning of the servomotor and gear arrangement in relation to the printed circuit board of a tachograph according to FIG. 2 and the installation space which is available.

39, 40, 41 and 42 designate spacer bolts which are provided for fastening the carriers 1, 2 on the printed circuit board 43 (FIG. 3). Tabs 48, 49, 50 and 51, which are formed on the carriers 1, 2 and are provided with through-passage bores 44, 45, 46 and 47, serve for aligning the carriers 1, 2 and the reading/writing units, stubs, which will not be described specifically but are formed in each case on a bearing part 52 and 53 of the reading/writing units, engaging in the through-passage bores 44, 45, 46, 47. Carriages 54 and 55 which are guided in the bearing parts 52, 53, and are assigned to the chip cards, have tongues 56 and 57 formed on them, via which the push rods 3, 4 act on the carriages 54, 55, i.e. the positioning of the reading/writing units and of the gear arrangement is coordinated such that, following installation of the subassemblies, the end surfaces of the tongues 56, 57 are located directly opposite the end surfaces of the push rods 3, 4.

Figure 2:
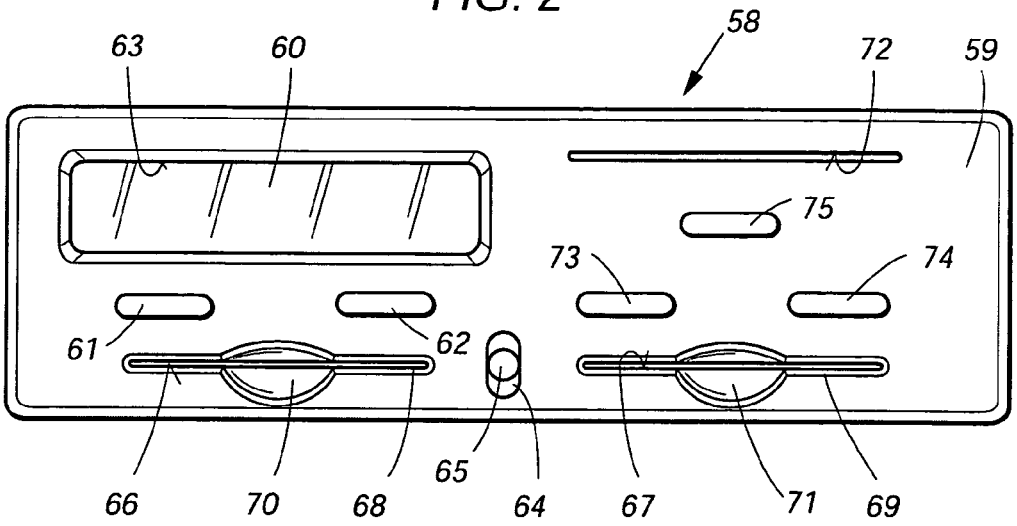
FIG. 2 shows a front view, which serves to provide an overview, of a tachograph with chip-card reading/writing units arranged in one plane.

FIG. 2 illustrates a tachograph 58 in the which the abovedescribed gear arrangement can be used. The tachograph has a front panel 59 which is connected to a cubicle built-in housing, behind which a display 60 is arranged and out of which buttons 61 and 62 project. 63 designates a window cutout assigned to the display 60, and a cover 64, which is assigned a lead seal 65, closes a plug socket provided for diagnostic and parameterization purposes. 66 and 67 designate slots which allow access to the reading/writing units provided for the personal chip cards assigned to the travel. In order to make it easier for the chip cards to be introduced, the slots 66, 67 are provided with funnel-like recesses 68 and 69 and with central finger hollows 70 and 71 such that the chip cards can be pushed into the respective reading/writing position. A slot which is designated 72 is provided for the through-passage of the printing carrier of a document printer arranged in the tachograph 58. Further buttons 73, 74 and 75 of the tachograph 58, which are guided in the front panel 59 and pass through the front wall, serve, in combination with the buttons 61 and 62, for selecting the drivers' most important working-period data, for paging forward and back through the records for a selected type of data, for initiating printing and for releasing the chip cards.

The partial section in FIG. 3 shows the relatively small amount of installation space, with a height in the order of magnitude of 10 mm, between the printed circuit board 43 and the base plate 76 of the tachograph, the gear arrangement according to the invention being realized within this installation space. 77 and 78 designate screws which are assigned to the spacer bolts 40, 42. A pair of screws 79/80 serves for fastening one of the reading/writing units, supporting means 81/82 which are integrally formed on the bearing parts 53 engaging with aligning action, by way of extensions 83/84, in the through-passage bores 45/47. An aperture which is designated 85, and is located in the covering 34, is provided for the lug 35. It can also be seen from FIG. 3 that, on account of the overall height which is available being utilized to the full, the gear arrangement helps to reinforce the tachograph housing, in particular in respect of the handling thereof prior to, and during, installation in a motor vehicle.

I claim:

1. A gear arrangement for alternately actuating two reading/writing units for chip cards and for transporting a chip card into a withdrawal position, the arrangement comprising:

a servomotor having a reversible direction of rotation;

a control slide comprising an operative connection with said servomotor;

a push-rod assigned to and disposed within each of said reading/writing units, said push rods being displaceable in a direction of movement of said chip cards;

wherein said control slide is in another operative connection to each of said push-rods such that, when said control slide moves, said push rods execute movements in opposite directions; and wherein said control slide is a rack with opposite toothing formations, and the arrangement comprises carriers comprising a gearwheel mounted therein, said gearwheel engaging a respective push rod and a toothing formation of said control slide.

2. The arrangement according to claim 1, wherein said units are substantially coplanar.

3. The arrangement according to claim 1, wherein said operative connection and said other operative connection further comprise gearing.

4. The arrangement according to claim 1, wherein said units are located within a tachograph.

5. The gear arrangement according to claim 1, further comprising:

guide grooves for said push rods; and two substantially identically configured carriers, each of said carriers comprising said guide grooves and said control slide.

6. The gear arrangement according to claim 5, wherein each of said carriers further comprises a covering which, in combination with said carriers, forms a bearing housing, and wherein said carriers further comprise means for aligning bearing housings and reading/writing units in relation to one another.

7. The gear arrangement according to claim 6, wherein said means for aligning are integrally formed on the carriers.

8. The gear arrangement according to claim 5, wherein at least said carriers are designed as a component which can be fastened in a tachograph.

9. The gear arrangement according to claim 8, further comprising a reduction gear, said reduction gear including bearing means provided between said servomotor and said control slide.

10. The gear arrangement according to claim 9, wherein said bearing means are formed in said component.

11. The gear arrangement according to claim 1, wherein said gearwheel comprises a pair of gearwheels, each of said pair provided with different numbers of teeth whereby when a tooted ring of said pair engages said control slide an other tooted ring engages said push rod.

* * * * *